US007708454B2

(12) United States Patent
Marmy et al.

(10) Patent No.: US 7,708,454 B2
(45) Date of Patent: May 4, 2010

(54) MOBILE MICROMECHANICAL ELEMENT WITH SHOCK CONTROLLED ROTATION

(75) Inventors: Philippe Marmy, Porrentruy (CH); Benjamin Krähenbühl, Bettlach (CH); Thierry Conus, Lengau (CH)

(73) Assignee: Omega S.A., Bienne (CH)

( * ) Notice: Subject to any disclaimer, the term of this patent is extended or adjusted under 35 U.S.C. 154(b) by 0 days.

(21) Appl. No.: 11/767,710

(22) Filed: Jun. 25, 2007

(65) Prior Publication Data

US 2008/0008051 A1 Jan. 10, 2008

(30) Foreign Application Priority Data

Jun. 23, 2006 (EP) ..... 06012946

(51) Int. Cl.
*G04B 17/20* (2006.01)
*G04B 15/00* (2006.01)

(52) U.S. Cl. ..... 368/127; 368/170

(58) Field of Classification Search ..... 368/170, 368/124–133

See application file for complete search history.

(56) References Cited

U.S. PATENT DOCUMENTS

| | | | | |
|---|---|---|---|---|
| 133,434 | A * | 11/1872 | Giroud | 368/133 |
| 185,323 | A * | 12/1876 | Holes | 368/131 |
| 987,768 | A * | 3/1911 | Stadel | 368/124 |
| 2,717,488 | A | 9/1955 | Linard | |
| 3,538,705 | A | 11/1970 | Perry | |
| 4,498,788 | A * | 2/1985 | Grimmer et al. | 368/106 |
| 6,307,815 | B1 * | 10/2001 | Polosky et al. | 368/220 |
| 6,322,246 | B1 * | 11/2001 | Leung | 368/299 |
| 2005/0217169 | A1 | 10/2005 | Kunz | |

FOREIGN PATENT DOCUMENTS

| | | |
|---|---|---|
| CH | 6659 | 6/1893 |
| CH | 230743 | 4/1944 |
| DE | 1 192 984 | 5/1965 |
| EP | 0 018 796 B1 | 11/1980 |
| EP | 1 445 670 A1 | 8/2004 |
| EP | 1580624 A2 | 9/2005 |
| EP | 1596260 A1 | 1/2008 |

OTHER PUBLICATIONS

Daniels, George, La Montre: Principes et Methodes de Fabrication, 1993, pp. 249-252.

European Search Report issued in corresponding application No. EP 06 01 2946, completed Mar. 26, 2007.

Australian Search Report issued in corresponding Singapore patent application No. SG 200704680-8, completed Nov. 26, 2007.

* cited by examiner

*Primary Examiner*—Vit W Miska
*Assistant Examiner*—Sean Kayes
(74) *Attorney, Agent, or Firm*—Griffin & Szipl, P.C.

(57) ABSTRACT

The mobile element includes a central rigid zone (2) provided with arms (6) extending radially from the central zone (2) towards a peripheral zone including teeth (8). The arms (6) are flexible to allow a small tangential and/or radial movement of the teeth (8) in order to absorb shocks. The invention is characterized in that the arms (6) are curved and bend gradually towards an orientation tangential to the rotation of the mobile element, in that the thickness of the arms gradually decreases, and finally, in that the ends of the arms form the teeth.

16 Claims, 3 Drawing Sheets

MOBILE MICROMECHANICAL ELEMENT WITH SHOCK CONTROLLED ROTATION

This application claims priority from European Patent Application No. 06012946.7, filed Jun. 23, 2006, the entire disclosure of which is incorporated herein by reference.

FIELD OF THE INVENTION

The present invention concerns a mobile micromechanical element, and particularly a wheel or a pinion, whose rotation is controlled by shocks on teeth arranged at the periphery thereof. The invention will be more specifically illustrated by an escape wheel of a sprung balance regulating system for a mechanical timepiece movement.

BACKGROUND OF THE INVENTION

In a known manner, the escapement of a mechanical timepiece movement, whether it be a Swiss or coaxial lever escapement, comprises a more or less complex assortment of parts, including an escape wheel whose regularly spaced teeth absorb the shock of the pallet stones, generally made of ruby. The shape of this wheel, shown in FIG. 2, has practically never changed. It comprises a central rigid zone 2, provided with an aperture 4 for driving onto an arbour; a rigid felloe 12 provided with teeth 8, and generally four arms 6, which are also rigid, which form a rigid part. Improvements have related to the number or shape of the teeth in particular for facilitating lubrication and reducing wear. Swiss Patent No. CH 230 743 and German Patent No. DE 1 192 984 disclose for example embodiments wherein the teeth comprise notches for forming oil reservoirs.

In order to have sufficient mechanical resistance, the material used for manufacturing such escape wheels is practically always a metal or alloy. This does not however totally exclude the risk of the teeth being damaged in the event of too violent shocks. This risk is further increased if a more shock sensitive material replaces the metal.

SUMMARY OF THE INVENTION

It is thus an object of the present invention to overcome the drawbacks of the prior art by providing a mobile element whose rotation is controlled by shocks on the teeth devised such that they are not damaged by said shocks.

The invention therefore concerns a mobile element of this type comprising a central zone of rigid material, and arms extending radially from the central zone towards a peripheral zone comprising teeth, the arms being flexible to allow a slight tangential and/or radial movement of the teeth in order to absorb shocks that could damage said teeth. The invention is characterized in that the arms are curved and bend gradually towards an orientation tangential to the rotation of the mobile element, in that the thickness of the arms decreases gradually and, finally, in that the ends of the arms form the teeth.

According to a first embodiment, the arms bend in the direction of rotation of said mobile element.

According to a second embodiment, the arms bend in the opposite direction to the direction of rotation of said mobile element, whereas at the end of the arms, the teeth are bent in the direction of rotation of said mobile element.

The central rigid part preferably comprises an aperture for driving in an arbour allowing the mobile element to rotate. This rotation can also be achieved using pivots integral with the central rigid zone.

In the following detailed description, the "mobile element" will be more particularly illustrated by the escape wheel of the sprung balance regulating system of a mechanical timepiece movement wherein the teeth undergo the shocks of pallet stones generally made of ruby.

BRIEF DESCRIPTION OF THE DRAWINGS

Other features and advantages of the present invention will appear from the following description of example embodiments of an escape wheel given by way of non-limiting illustration, with reference to the annexed drawings, in which.

DETAILED DESCRIPTION OF THE INVENTION

The present invention will be more specifically illustrated by a coaxial lever escapement wherein the teeth of the escape wheel undergo the pallet-stone shocks.

Figure 1:
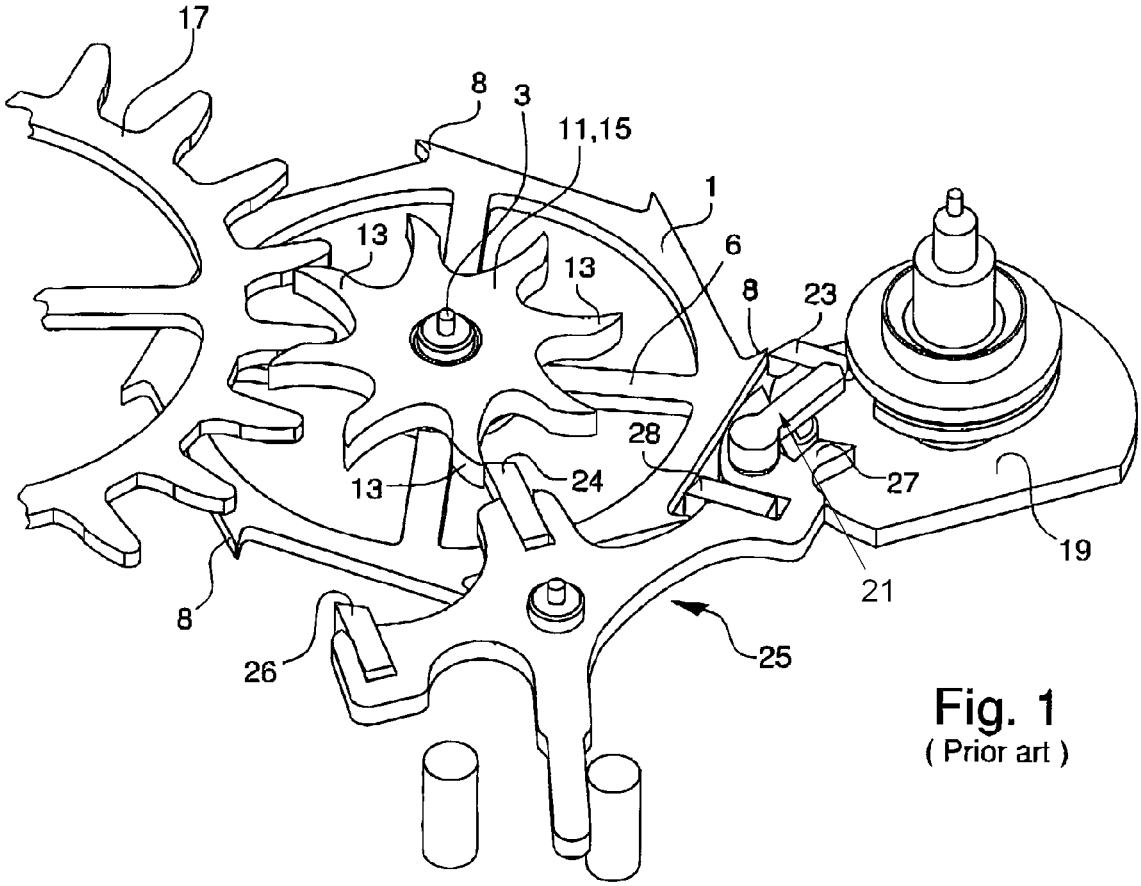
Fig. 1 ( Prior art )
FIG. 1 is a perspective diagram of a coaxial lever escapement of the prior art.
Figure 2:
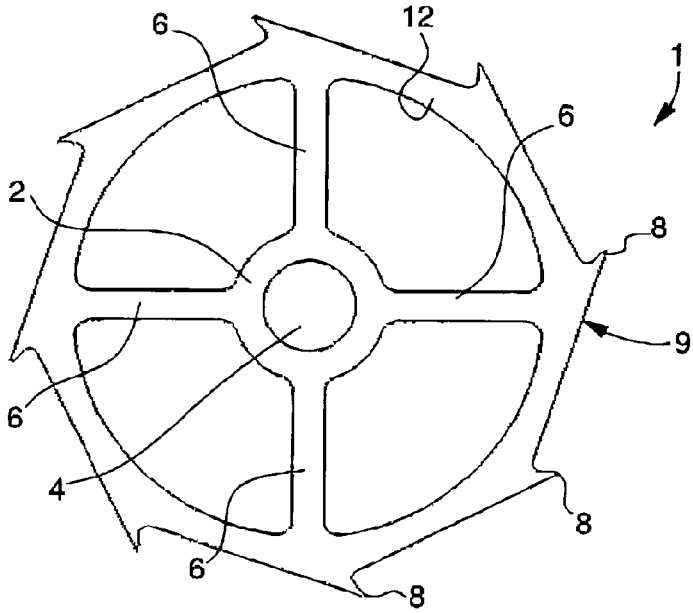
Fig. 2 ( Prior art )
FIG. 2 is a top view of the escape wheel of FIG. 1.

This type of escapement is known from the prior art for example from EP Patent No. 018 796, an improvement to and the operation of which are also described in the work by G. Daniels entitled "La Montre: Principes et Méthodes de Fabrication", pages 249-252, editions Scriptar S. A., La Conversion, Lausanne, 1993. The improved version is illustrated in FIGS. 1 and 2.

Described briefly, this mechanism comprises a first escape wheel 1 and a second escape wheel 11, also called the impulse pinion, mounted on the same arbour 3. The two escape wheels are secured to each other in rotation and they possess the same number of teeth. The first escape wheel 1 has the shape shown in FIG. 2, i.e. the shape of a conventional Swiss lever escape wheel. In this improved version of the coaxial escapement, the impulse pinion 11 also acts as escape pinion 15 by meshing with an intermediate wheel 17, which has the advantage of reducing the height of the mechanism. The table roller 19 of the balance carries an impulse pin 21 and a direct impulse pallet stone 23 arranged for cooperating with the teeth 8 of the first escape wheel 1. The pallet stones, carried by a pivoted lever 25, whose fork 27 cooperates with impulse pin 21, comprise an indirect impulse pallet 24 which cooperates with the teeth 13 of the second escape wheel 11 and two, respectively entry and exit, pallet stones 26, 28, which cooperate with the teeth 8 of the first escape wheel 1. The construction of this type of coaxial escapement demands restricted tolerances, such that this escapement is especially reserved for top of the range timepieces.

Figure 5:
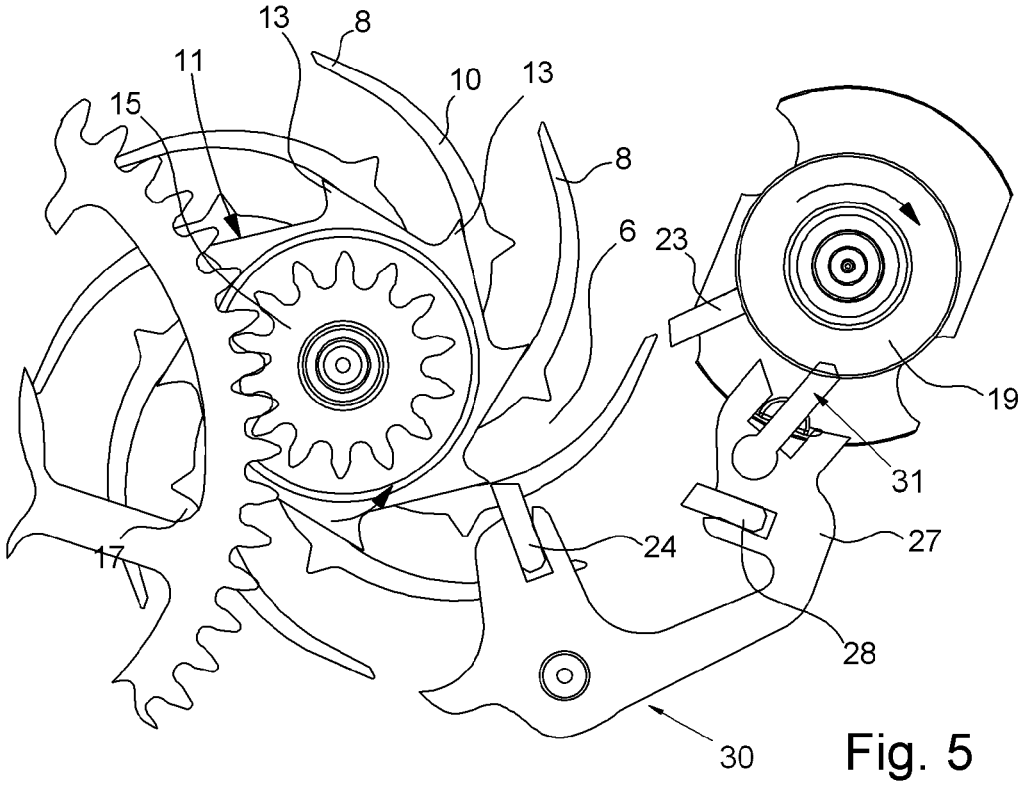
FIGS. 5 and 6 are schematic diagrams of an escape wheel according to the present invention integrated in an escapement mechanism.

In normal operation, when the table roller 19 is being driven clockwise, as represented by the arrow in FIG. 5, locking occurs on entry pallet 26.

Figure 6:
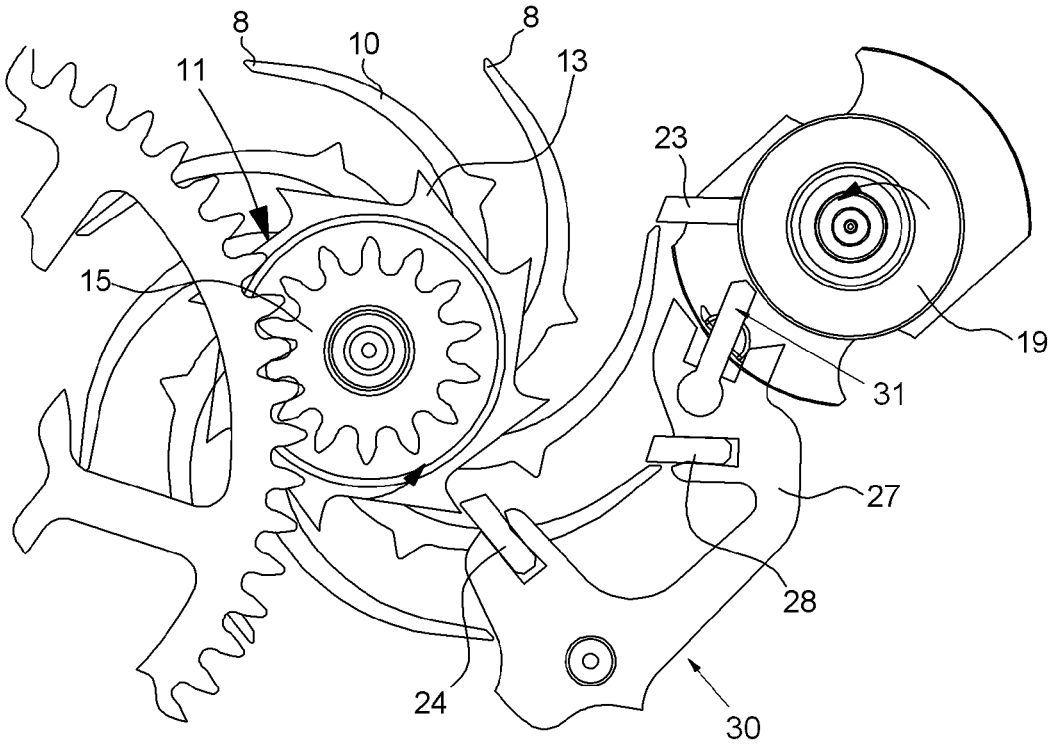

When the table roller 19 is being driven anti-clockwise, as represented by the arrow in FIG. 6, locking occurs on the exit pallet 28 and it can be seen that the direct impulse pallet 23 passes very close to one tooth 8 of the first escape wheel 1, which means that this escapement has to be constructed with very precise dimensions.

The present invention is innovative in that the teeth have certain radial and tangential flexibility so as to be able to absorb shocks.

Figure 3:
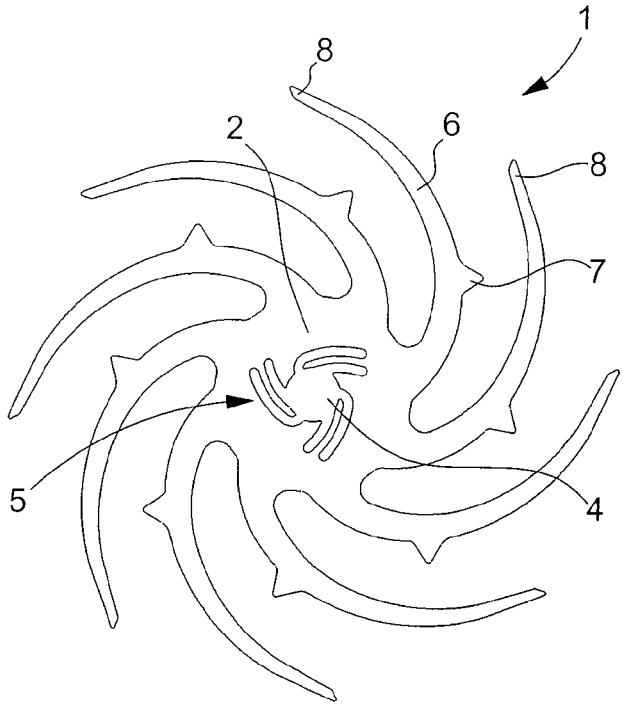
FIG. 3 shows a first embodiment of an escape wheel according to the present invention.

FIG. 3 corresponds to the escape wheel 1 shown in FIGS. 5 and 6, for explaining the operation of a coaxial escapement, and shows a first embodiment.

As can be seen, arms 6 are curved and bent gradually towards a tangential orientation, in the direction of rotation of the mobile element. Arms 6 are relatively thin given the length thereof, which gives them flexibility. Moreover, wheel 1 does not have a felloe, teeth 8 being formed by the ends of arms 6. The absence of a felloe has the advantage of giving each arm 6 the possibility of bending independently of the other arms. As arms 6 are not simply orientated radially like the arms of the prior art, they have the possibility of bending both radially and tangentially. Moreover, the configuration of the arms which "wind" around the wheel, means the arms can be longer for a given wheel diameter.

It can also be seen that the ends 8 of the arms end in a flat portion. This flat portion is provided for cooperating with the pallet stones 23, 26, and 28 like the flank of the teeth of the escape wheel of the prior art shown in FIG. 2. The elasticity of arms 6 is provided for absorbing the shocks caused by collisions between teeth 8 and the pallet stones. As shown in FIGS. 5 and 6, the pallet stones are carried by a pivoted lever 30. The pivoted lever 30 cooperates with an impulse pin 31 carried by a balance. Indeed, these shocks cause considerable stress and could break an arm made of brittle material.

According to the present invention, the curvature of arms 6 is progressive so as to distribute the stress caused by a shock over the entire length of the arms. Moreover, it can also be seen in FIG. 3 that the thickness of the arms decreases gradually towards the end thereof. Indeed, it will be understood that, in the configuration shown, the shear stress is greater at the start of the arms than at the end thereof. In such conditions, the gradual thinning of the arms reconciles the contradictory requirements of flexibility and strength.

In the example shown, escape wheel 1 comprises eight arms 6 and the same number of teeth 8. It is evident that the number of arms and teeth could be different than eight.

Figure 4:
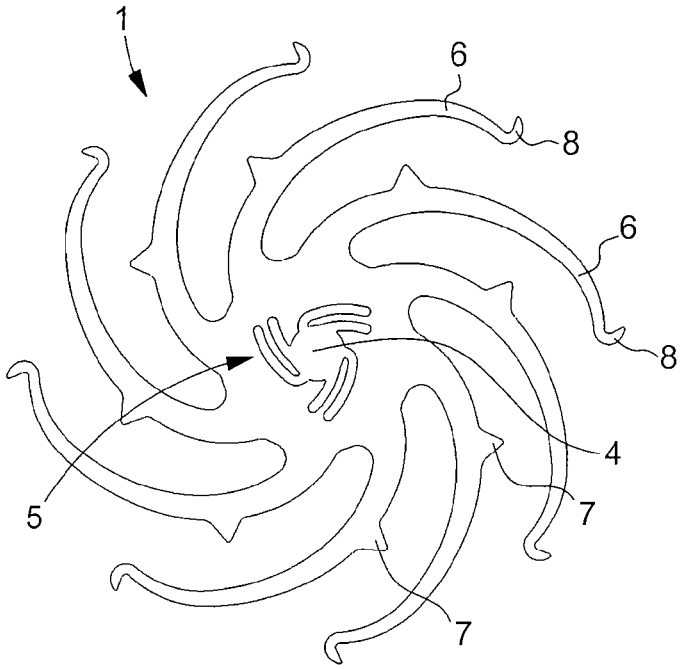
FIG. 4 shows a second embodiment.

FIG. 4 shows a second embodiment. It differs from the preceding embodiment in that arms 6 "wind" around the wheel in the opposite direction to the direction of rotation of the wheel. It can be seen that, in this embodiment, each tooth is formed by a portion 8 of the end of an arm, which is bent in the direction of rotation of the wheel.

In FIGS. 3 and 4 it can also be seen that the central aperture 4 comprises an arrangement 5 allowing certain elasticity to be obtained. This arrangement 5 is particularly advantageous when the material used to make the escapement is a material that has some flexibility but is brittle, such as glass, quartz or silicon.

It can also be seen that arms 6 comprise bulges 7. These bulges are used for angularly positioning the impulse pinion 11 relative to escape wheel 1 when the escapement mechanism is assembled. Once the wheel and pinion are correctly orientated relative to each other, these two parts are secured to each other by bonding or any other suitable method. It will be observed that the escape pinion 11 could also have the features of one of the configurations that have just been described for escape wheel 1.

A mobile element of this type according to the invention can be made in accordance with techniques known in the field. If the material used is a metal or alloy, the mobile element could be cut in a plate by stamping, wire spark machining, etc. . . . or be shaped by the LIGA technique. If the material used is a fragile material, such as glass, quartz and silicon, the mobile element could be shaped by etching.

What is claimed is:

1. A sprung balance regulating system of a mechanical timepiece movement, the sprung balance regulating system comprising:

(a) an escape wheel, wherein the escape wheel includes i. a central rigid zone; and ii. arms extending radially from the central zone towards a tip zone, wherein the tip zone includes teeth;

(b) a balance carrying an impulse pin; and (c) a pivoted lever arranged to cooperate with the impulse pin, wherein rotation of the escape wheel is controlled by shocks caused by collisions between the teeth and the pivoted lever, wherein the arms are flexible to allow a small tangential movement, or radial movement, or tangential and radial movement, of the teeth in order to absorb the shocks caused by collisions between the teeth and the pivoted lever, wherein the arms are curved gradually towards an orientation tangential to the rotation of the escape wheel, wherein the thickness of the arms gradually decreases from the central zone to the tip zone, and wherein the teeth are formed by the ends of the arms.

2. The sprung balance regulating system according to claim 1, wherein the arms curve in the opposite direction to the direction of rotation of the escape wheel, and wherein at the end of the arms, the teeth are angled in the direction of rotation of the escape wheel.

3. The sprung balance regulating system according to claim 2, further comprising an impulse pinion mounted coaxially on the escape wheel.

4. The sprung balance regulating system according to claim 1, wherein the arms curve in the direction of rotation of the escape wheel.

5. The sprung balance regulating system according to claim 4, further comprising an impulse pinion mounted coaxially on the escape wheel.

6. The sprung balance regulating system according to claim 1, wherein the central rigid zone is provided with an aperture for the fitting thereof to an arbour.

7. The sprung balance regulating system according to claim 6, wherein the central aperture includes an arrangement giving said aperture elasticity for fitting the escape wheel onto the arbour.

8. The sprung balance regulating system according to claim 7, further comprising an impulse pinion mounted coaxially on the escape wheel.

9. The sprung balance regulating system according to claim 6, further comprising an impulse pinion mounted coaxially on the escape wheel.

10. The sprung balance regulating system according to claim 1, wherein the escape wheel is made of metal or an alloy and machined in a plate or shaped by LIGA technology.

11. The sprung balance regulating system according to claim 10, further comprising an impulse pinion mounted coaxially on the escape wheel.

12. The sprung balance regulating system according to claim 1, wherein the escape wheel is made of a brittle material selected from the group consisting of glass, quartz, and silicon, and is shaped by etching.

13. The sprung balance regulating system according to claim 12, further comprising an impulse pinion mounted coaxially on the escape wheel.

14. The sprung balance regulating system according to claim 1, wherein the escape wheel is part of the regulating system of a mechanical timepiece movement, which includes an impulse pinion mounted coaxially on the escape wheel.

15. The sprung balance regulating system according to claim 14, wherein the arms include bulges for indexing the angular position of the impulse pinion.

16. The sprung balance regulating system according to claim 1, wherein the escape wheel is constructed without a felloe.

* * * * *